US006045323A

United States Patent [19]

Achelpohl et al.

[11] Patent Number: 6,045,323

[45] Date of Patent: Apr. 4, 2000

[54] DEVICE FOR ELIMINATING DEFECTIVE FLAT OBJECTS AND FOR FORMING STACKS OF FLAWLESS FLAT OBJECTS

[75] Inventors: Fritz Achelpohl, Lienen; Uwe Köhn, Osnabruck, both of Germany

[73] Assignee: Windmöller & Hölscher, Leingerich, Germany

[21] Appl. No.: 09/116,901

[22] Filed: Jul. 17, 1998

[30] Foreign Application Priority Data

Jul. 17, 1997 [DE] Germany ..... 197 30 758

[51] Int. Cl.[7] ..... B65G 57/11

[52] U.S. Cl. ..... 414/790.8; 271/303; 271/305; 209/552; 209/656

[58] Field of Search ..... 414/789.9, 790.8; 271/303, 305; 209/552, 615, 656

[56] References Cited

U.S. PATENT DOCUMENTS

| | | | |
|---|---|---|---|
| 3,866,902 | 2/1975 | Feldkamper . | |
| 4,235,434 | 11/1980 | Muller | 271/305 |
| 4,326,636 | 4/1982 | Kawakami | 209/534 |
| 4,499,834 | 2/1985 | Reuetschle et al. | 209/656 |
| 4,619,452 | 10/1986 | Euteneuer | 271/305 |
| 4,676,495 | 6/1987 | Hughes | 271/305 |
| 5,226,547 | 7/1993 | Malatesta | 209/900 |
| 5,346,206 | 9/1994 | Steinhart | 271/305 |
| 5,542,547 | 8/1996 | Ricciardi | 209/656 |
| 5,617,956 | 4/1997 | Werner | 209/534 |
| 5,702,341 | 12/1997 | Keilhau | 271/303 |

FOREIGN PATENT DOCUMENTS 42 34 758 4/1994 Germany .

*Primary Examiner*—Douglas Hess
*Attorney, Agent, or Firm*—Jacobson, Price, Holman & Stern PLLC

[57] ABSTRACT

A device for eliminating defective flat objects, which are being conveyed individually and at a distance from each other, preferably tubular segments or sack workpieces during the production of sacks, and for forming stacks of flawless objects, said device comprising a twin belt conveyor, which conveys the objects and comprises groups of continuous belts that are spaced apart and cycle parallel to each other; comprising a system for scanning the objects; and comprising a shunt, which eliminates the objects that are recognized to be defective. Behind the discharge end of the twin belt conveyor there is a stack shaft with an intermediate stacker plate, and before the discharge end there is a rake-shaped deflecting element, which forms the shunt and can be moved between the bottom conveying run of the twin belt conveyor and which guides the objects, recognized to be defective, into a place of deposit, arranged above the stack shaft.

4 Claims, 1 Drawing Sheet

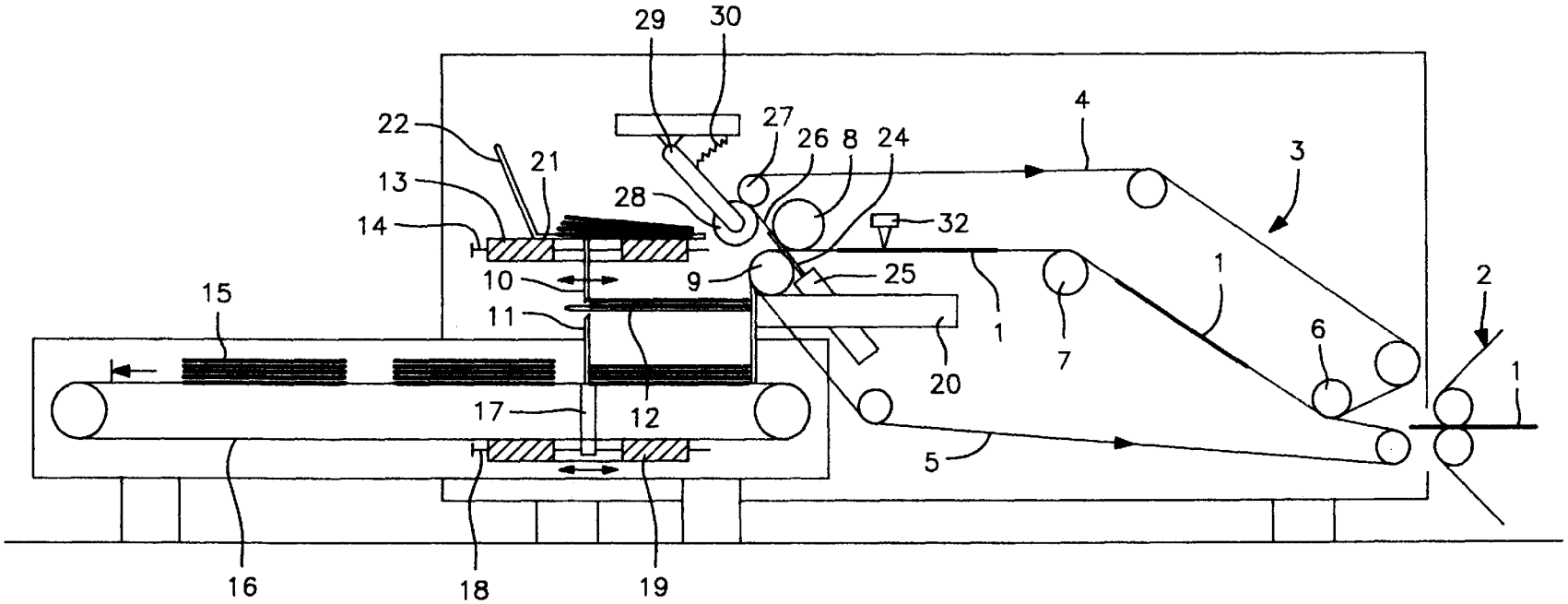
1
2
3
4
5
6
7
8
9
10
11
12
13
14
15
16
17
18
19
20
21
22
24
25
26
27
28
29
30
32

DEVICE FOR ELIMINATING DEFECTIVE FLAT OBJECTS AND FOR FORMING STACKS OF FLAWLESS FLAT OBJECTS

FIELD OF THE INVENTION

The invention relates to a device for eliminating defective flat objects, which are being conveyed individually and at a distance from each other, preferably tubular segments or sack workpieces during the production of sacks, and for forming stacks of flawless objects, said device comprising a twin belt conveyor, which conveys the objects and comprises groups of continuous belts that are spaced apart and cycle parallel to each other, comprising a system for scanning the objects, and comprising a shunt, which eliminates the objects that are recognized to be defective.

BACKGROUND OF THE INVENTION

In the production and/or processing of flat objects, such as sheets, tubular segments or sack workpieces, it is necessary to stack the flat objects for collection, during which process the defective workpieces must be eliminated, in order to prevent trouble during the processing operation in the case of intermediate stacking or to prevent the delivery of defective workpieces.

There exists, for example, from the DE-OS 22 29 286 a device of the aforementioned type, which consists of a switch tongue, which is pivot-mounted between two twin belt conveyors and guides the workpieces, which have been recognized to be defective, out of the main conveying route into a sorting out path. The prior art device is relatively expensive insofar as it is connected into the main conveying path and subdivides said path into a branch for flawless workpieces, which are guided, for example, to a stacking device, and into an elimination conveying path.

SUMMARY OF THE INVENTION

Therefore, the object of the invention is to provide a simpler device of the type described in the introductory part.

The invention solves this problem in that behind the discharge end of the twin belt conveyor there is a stack shaft with an intermediate stacker plate, and before the discharge end there is a rake-shaped deflecting element, which forms the shunt and can be moved between the bottom conveying run of the twin belt conveyor and which guides the objects, recognized to be defective, into a place of deposit arranged above the stack shaft.

The device, according to the invention, results in a significant simplification of the design because the flat objects, discharged by the twin belt conveyor, are stacked immediately and during the stacking operation the defective objects, detected by the sensors, are eliminated merely by moving in a deflecting element and are thrown into a tray for defective objects.

Expediently the deflecting device can be moved in and out by means of a pneumatic cylinder. The pneumatic cylinder can be activated suddenly and can also be prestressed in order to raise the speed of actuation.

A preferred embodiment of the invention provides that, as the carrying run of the twin belt conveyor slopes upward in the conveying direction, it runs from the deflecting roll, which forms the end of the conveying distance, over a top deflecting roll; that a contact roll is employed so as to be elastic at the obliquely rising run; and that the deflecting element can be moved between the deflecting rolls, which form the end of the conveying distance and of which the bottom roll lies before the top roll in the conveying direction, approximately parallel to the obliquely rising run. The design, according to the invention, guarantees that the workpieces, recognized to be defective, are reliably eliminated and guided to the reject tray and are, thus, excluded from the stacking operation.

Expediently the intermediate place of deposit comprises a horizontal stack rake, which can be moved in and out of the shaft. Stacks, comprising a predetermined number of workpieces, which are counted by a special counter, are formed on this stack rake. When a stack of a predetermined number of items has been formed, the intermediate stacker plate can be moved out and back in again in a short period of time, so that the stack with a specified number of items falls to the bottom in the stack shaft and can be carried away, while the intermediate stacker plate, which is immediately moved into position again, catches the first workpiece of the next stack to be formed.

Expediently the bottom of the stack shaft comprises a conveyor belt, which carries the stacks away in a timed pattern.

BRIEF DESSCRIPTION OF THE DRAWINGS

One embodiment of the invention is explained in the following with reference to the drawing, whose single FIGURE is a diagrammatic side view of the device.

DETAILED DESCRIPTION OF THE PREFERRED EMBODIMENTS

The drawing shows a device for forming stacks of a predetermined number of flawless flat workpieces, for example tubular segments for producing sacks, and for the elimination of defective workpieces.

The workpieces 1 are conveyed by a twin belt conveyor 2 and fed into the belt mouth of the twin belt conveyor 3. The twin belt conveyor 3 comprises a group of upper continuous belts 4 and a group of bottom continuous belts 5, whose individual belts, which cycle parallel and at a distance from each other, run in the illustrated manner over deflecting rolls, of which one roll is provided with a drive. The conveying distance of the twin belt conveyor 3 is formed by means of the conveying runs of the group of belts running over the deflecting rolls 6 to 9. The deflecting rolls 8, 9 form the end of the conveying distance and thus the discharge end, from which the workpieces 1 are thrown into a stack shaft, to the extent that no error message is sent.

The stack shaft exhibits side terminating walls (not illustrated) and front terminating walls 10, 11, between which a slit is formed, into which an intermediate stacker plate 12 can be slid.

The front terminating wall 10 can be slid in a guide of a machine part 13 in the horizontal direction by means of a worm gear 14 (shown only schematicly) in the direction of the double arrow in order to make adjustments relative to the different shapes of the workpieces.

The bottom terminating wall 11 comprises a rake-like grate, whose individual fingers extend between the individual continuous belts of the stack belt conveyor 16, which serves to carry away the stacks 15. To move the grate-like terminating wall 11 in and out, there is a pneumatic piston-cylinder unit 17. To make adjustments with respect to the shapes of the workpieces to be stacked, the cylinder of the pneumatic piston-cylinder unit 17 can also be slid by means of a worm gear 18 in guides of a machine part 19 in the direction of the double arrow.

The intermediate deposit 12 also comprises a grate-like support with freely cantilevered fingers, which can be moved in and out by means of a pneumatic piston-cylinder unit 20.

Above the machine part 13 there is a tray 21 with rear stop plate 22. The workpieces, which are recognized to be defective, are thrown onto this tray 21.

To sort out and take away the defective workpieces, a rake-like deflecting element 24, which is moved in and out by means of the pneumatic piston-cylinder unit 25, reaches between the deflecting rolls 8 and 9 by means of the group of belts, forming the bottom carrying run of the twin belt conveyor 3. The deflecting element can be slid parallel to the belt run 26, which travels from the deflecting roll 8 to the deflecting roll 27. A roll 28 is employed at the belt run 26, which slopes upward to the front in the conveying direction; said roll is mounted between pivot-mounted arms 29, where the arms 29 are driven by a tension spring 30, which forces the roll against the belt run 26.

Above the conveying run of the twin belt conveyor 3 there is a monitoring device 32, which comprises, for example, photocells and which controls in such a manner the pneumatic piston cylinder unit 25 by means of an electronic controller (not illustrated) that the deflecting element 24, which consists of a rake, can be moved out suddenly and the workpiece 1, recognized to be defective, is steered onto the tray 21.

The flawless workpieces, thrown into the stack shaft, are stacked on the intermediate stacker plate 12 into stacks of a predetermined number of items, in which procedure there is a counter (not illustrated). When stacks of a specified number of items have been formed on the intermediate stacker plate 12, the intermediate stacker plate 12 is suddenly moved out and into position again, so that the stack falls onto the stack belt 16 and the next discharged workpiece is caught by the intermediate stacker plate that is moved into position again.

As soon as a stack has been deposited on the stack belt 16, the stop 11 is moved in and the stack belt 16 is intermittently switched ahead by one conveying step.

We claim:

1. A device for eliminating defective flat objects, which are being conveyed individually and at a distance from each other, and for forming stacks of flawless objects, said device comprising a twin belt conveyor, which conveys the objects and comprises groups of continuous belts that are spaced apart and cycle parallel to each other; a system for scanning the objects; and shunt, which eliminates the objects that are recognized to be defective, behind a discharge end of the twin belt conveyor there being a stack shaft with an intermediate stacker plate and before a discharge end there is a rake-shaped deflecting element, which forms the shunt and can be moved between a bottom conveying run of the twin belt conveyor and which guides the objects, recognized to be defective, into a place of deposit arranged above the stack shaft, a carrying run of the twin belt conveyor sloping upwardly in the conveying direction, the conveyor running from a deflecting roll, which forms the end of the conveyor distance, over a top deflecting roll, a contact roll employed so as to be elastic at an obliquely rising run, and the deflecting element being movable approximately parallel to the obliquely rising run between the deflecting rolls, which form the end of the conveying distance and of which a bottom roll lies before a top roll in the conveying direction.

2. A device as claimed in claim 1, wherein the deflecting device element can be moved in and out by a pneumatic piston cylinder unit.

3. A device as claimed in claim 1, wherein the bottom of the stack shaft comprises a conveyor belt, which carries away the stacks in a timed pattern.

4. A device as claimed in claim 1, wherein the intermediate stacker plates comprises a horizontal stack rake, which can be moved in and out of the shaft.

* * * * *